US005669222A

United States Patent [19]

Jaster et al.

[11] Patent Number: 5,669,222

[45] Date of Patent: Sep. 23, 1997

[54] REFRIGERATION PASSIVE DEFROST SYSTEM

[75] Inventors: Heinz Jaster, Schenectady; David Joseph Najewicz, Clifton Park, both of N.Y.

[73] Assignee: General Electric Company, Schenectady, N.Y.

[21] Appl. No.: 660,021

[22] Filed: Jun. 6, 1996

[51] Int. Cl.[6] ..... F25B 47/02

[52] U.S. Cl. ..... 62/156; 62/277; 62/278; 62/81

[58] Field of Search ..... 62/156, 151, 197, 62/196.1, 81, 277, 278

[56] References Cited

U.S. PATENT DOCUMENTS

| | | | |
|---|---|---|---|
| 4,246,760 | 1/1981 | Cann et al. | 62/81 |
| 4,420,943 | 12/1983 | Clawson | 62/277 X |
| 4,813,239 | 3/1989 | Olson | 62/278 X |
| 5,056,328 | 10/1991 | Jaster et al. | 62/180 |
| 5,103,650 | 4/1992 | Jaster | 62/198 |
| 5,134,859 | 8/1992 | Jaster | 62/503 |
| 5,157,943 | 10/1992 | Jaster et al. | 62/513 |
| 5,184,473 | 2/1993 | Day | 62/199 |
| 5,269,151 | 12/1993 | Dinh | 62/81 |
| 5,402,656 | 4/1995 | Jaster et al. | 62/515 |

*Primary Examiner*—Harry B. Tanner

*Attorney, Agent, or Firm*—Patrick K. Patnode; Donald S. Ingraham

[57] ABSTRACT

A refrigeration system includes a compressor, a condenser, an expansion throttle, an evaporator and a control valve. All of the above elements are connected in series, in that order, in a refrigerant flow relationship. During periods in which the compressor initiates a passive defrost mode, control valve disposed within the conduit connecting the compressor and the evaporator remains open. Liquid refrigerant, by force of gravity, drains from the bottom of evaporator through the conduit to the compressor. This draining liquid refrigerant is evaporated by the hot compressor, flowing upward to the cold evaporator surfaces and condensing. The condensation releases latent heat of vaporization and heats the surface of the evaporator melting ice buildup thereon. In another embodiment, the refrigeration system further includes a bypass line connecting the compressor to the top of the evaporator. The inclusion of the bypass line allows the flow of the evaporated refrigerant to flow directly from the compressor to the evaporator through the bypass line, and the flow of liquid refrigerant to flow directly from the evaporator to the compressor through the conduit, such that no counter-current liquid and vapor flow within one conduit is required.

13 Claims, 2 Drawing Sheets

REFRIGERATION PASSIVE DEFROST SYSTEM

BACKGROUND OF THE INVENTION

This application relates to refrigeration systems, and in particular relates to a passive defrost system for refrigeration systems.

Household refrigerators typically operate on a simple vapor compression cycle. Such a cycle typically includes a compressor, a condenser, an expansion device, and an evaporator connected in series and charged with a refrigerant. The evaporator is a specific type of heat exchanger which transfers heat from air passing over the evaporator to refrigerant flowing through the evaporator, thereby causing the refrigerant to vaporize. The cooled air is then used to refrigerate one or more freezer or fresh food compartments.

During operation of conventional refrigeration systems, condensed moisture forms as frost or ice on the exposed surfaces of the evaporator. Since ice accumulation will eventually cause cycle efficiency degradation, the evaporator must periodically undergo a defrosting period. Two defrosting schemes are currently available in conventional refrigeration systems, manual defrosting or automatic defrosting.

Manual defrosting requires that the refrigeration system be placed in an inoperative condition for a period of time. It also requires that the food products be removed from the evaporator region, typically the freezer compartment, in order to apply the necessary amount of heat which is required to effect sufficient melting of the ice accumulations on the exposed evaporator surfaces. Generally, manual defrosting creates a significant cleanup problem.

Automatic defrosting refrigeration systems are typically equipped with electrical heaters positioned within the evaporator region. These electrical heaters are periodically activated during times when the compressor and fans are shut down, melting the ice which forms on the exposed evaporator surfaces.

While the current technology of automatic defrosting refrigeration systems do accomplish the intended objectives, these systems require incorporation of components that increase the basic cost of a refrigeration system. One type of automatic defrosting refrigeration system provides a calrod-type heater in direct contact with the evaporator surface (conductive defrost). Other types of automatic defrosting refrigeration systems provide self-standing heaters positioned within the evaporator region which provide heat to the evaporator surfaces by radiation and convection. Self-standing heaters typically operate at very high temperatures (e.g. 1200° F.). The addition of these heating components often complicates the design and configuration of the evaporator as well as restricting the physical location of the evaporator typically within the freezer compartment.

An additional disadvantage of current automatic defrost refrigeration systems is that the defrosting energy used is parasitical. To complete defrosting, it is necessary to apply heat over a prolonged period of time in order to assure sufficient heat transfer to effect melting of any ice buildup. Accordingly, automatic defrosting systems result in greater system energy use because much of the defrost heat is unavoidably diverted to un-iced surfaces. Once this additional heat is deposited within the refrigeration system, the heat must be removed by way of the refrigeration cycle, requiring the expenditure of additional amounts of energy, adding to the refrigeration cost. Furthermore, the electricity associated with the operation of the electrical heater within the evaporator region adds to the operational costs of conventional automatic defrosting refrigeration systems.

A further disadvantage of current automatic defrost refrigerators is that such systems cannot be applied or incorporated within hydro-carbon refrigeration systems which have recently become popular in many regions of the world. Hydro-carbon refrigerants, for example isobutane, are utilized within this type of refrigeration system. Hydro-carbon refrigerants operate at greater efficiency and have negligible greenhouse effects when compared to a typical refrigerant such as dichlorodifluoromethane, however, hydro-carbon refrigerants are extremely explosive. Accordingly, current refrigeration systems which utilize hydro-carbon refrigerants require manual defrosting as the inclusion of an electrical defrost heater would provide a spark source for the explosive hydro-carbon refrigerants.

A passive defrost system for a heat pump using waste heat is discussed in U.S. Pat. No. 5,269,151 issued to Dinh. Dinh, however, involves the use of a heat-exchanger or storage defrost module containing a thermal storage material such as a phase change material to capture and store waste heat contained in liquid refrigerant to effect defrost within a heat pump. Furthermore, Dinh discusses the use of pressure responsive valves which are closed by the pressure generated by the compressor when the compressor is activated and which open when the compressor is deactivated to allow refrigerant flow between the defrost module and the outdoor coil. First, adding such structures to a refrigeration system would be expensive. In the competitive household refrigeration market, any additional expenses should be avoided. Additionally, because the valves in Dinh open when the compressor is deactivated and close by the pressure generated when the compressor is activated, the Dinh system results in a defrost cycle after each compressor shutdown. Current defrost energy use is about 400 Watts for 15 minutes per day. In a typical refrigeration system, the compressor shuts down about once per hour. Accordingly, even if the Dinh system deposits 75% less heat into the refrigeration system during each defrost cycle, the Dinh system would still deposit about 6 times as much heat into a refrigeration system, as that of a conventional system, in one day.

Therefore, it is apparent from the above that there exists a need in the art for improved defrosting within refrigeration systems. In particular, it is desirable for an automatic defrost system to provide defrosting to a refrigeration system without adding component parts such as a heating element or a heat-exchanger (as disclosed in Dinh) to the refrigeration system. In addition, an automatic defrost system should provide defrosting to a refrigeration system for short fixed periods of time per day, not each time a compressor is de-activated (as disclosed in Dinh). It is a purpose of this invention, to fulfill this and other needs in the art in a manner more apparent to the skilled artisan once given the following disclosure.

SUMMARY OF THE INVENTION

In accordance with this invention, a refrigeration system comprises a compressor, a condenser, an expansion throttle, an evaporator, and a control valve, each of the above elements connected in series, in that order, in a refrigerant flow relationship. The refrigeration system further comprises a controller which is electrically coupled to the compressor and to the control valve. The controller generates a compressor signal which causes the compressor to activate or de-activate and generates a valve signal which causes the control valve to move between an open and a closed position.

During periods in which the controller initiates a passive defrost mode, the control valve, disposed within the conduit connecting the compressor and the evaporator, remains open. Liquid refrigerant drains from the evaporator into the compressor through the interconnecting conduit and is evaporated by the hot compressor parts. The evaporated refrigerant flows upward through the conduit to the cold evaporator surfaces and condenses. The condensation of the refrigerant upon the evaporator or within the vicinity of the evaporator, releases latent heat of vaporization and heats the evaporator, melting any ice buildup. A defrost termination sensor, positioned within the evaporator region, generates a signal in correspondence with the temperature of the evaporator region. The controller monitors the temperature to determine if a predetermined defrost temperature has been reached. The defrost temperature should correspond to a temperature at which all ice should have been melted on the exposed surfaces of the evaporator. Once the defrost termination sensor generates a signal indicating that the defrost temperature within the evaporator region has been reached, the controller generates a valve signal which causes the control valve to move to a closed position, thus preventing additional hot refrigerant vapor from entering the evaporator region. In another embodiment, the refrigeration system further includes a bypass line which connects the compressor to the top of the evaporator. The inclusion of the bypass line allows the flow of the evaporated refrigerant to flow directly from the compressor to the evaporator through the bypass line, and the flow of liquid refrigerant to flow directly from the evaporator to the compressor through the conduit, such that no counter-current liquid and vapor flow in the same conduit is required.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
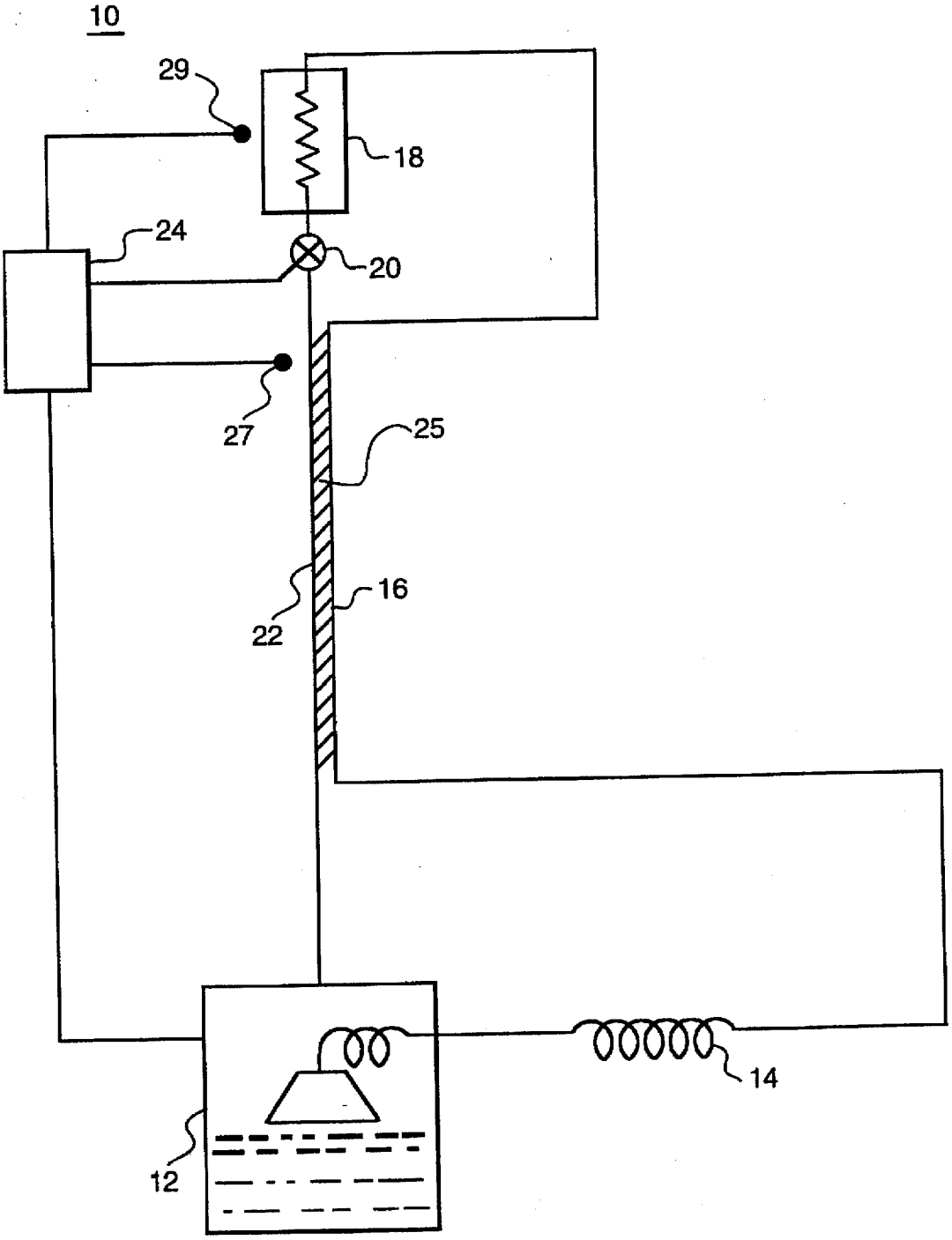
FIG. 1 is a schematic representation of one embodiment of a refrigeration system in accordance with the present invention.

A refrigeration system 10 comprises a compressor 12, a condenser 14, an expansion throttle 16, an evaporator 18, and a control valve 20, as illustrated in FIG. 1. A conduit 22 connects compressor 12 and evaporator 18, providing flow communication therebetween. Control valve 20 is disposed within conduit 22 to control refrigerant flow therethrough. Control valve 20 typically comprises an electrically controlled valve, for example a solenoid valve. Each of the above mentioned elements are connected in series, in that order, in a refrigerant flow relationship for providing cooling to a freezer and/or a fresh food compartment. Refrigeration system 10 further comprises a controller 24 which is electrically coupled to compressor 12 and to control valve 20. Controller 24 comprises circuitry, such as a microprocessor chip or the like, that generates a compressor signal which causes compressor 12 to activate (that is, run or operate to compress refrigerant) or de-activate and controller 24 further generates a valve signal to control the position of control valve 20 to move between an open and a closed position. Refrigeration system 10 may comprise additional components, as a "series connection," as used herein, means that, during normal operation, refrigerant is conveyed through each of these components. The refrigerant used within refrigeration system 10 can be any refrigerant including but not limited to 1,1,1,2-tetrafluoroethane, dichlorodifluoromethane, ammonia, propane or any of the refrigerants classified as hydro-carbon refrigerants, for example isobutane.

A freezer or fresh food compartment typically comprises a housing formed with thermally insulated walls and provided with an opening or a door for placement or removal of food articles or the like into or from the interior of the freezer or fresh food compartment. As is customary, refrigeration system 10 is provided in thermal association with the freezer or fresh food compartment, having several components of refrigeration system 10 mounted on or in the housing containing the freezer or fresh food compartment and adapted with the freezer or fresh food compartment to cool the interior thereof.

Compressor 12 may comprise any type of compressor or mechanism which provides a compressed refrigerant output such as a single stage compressor, a rotary compressor, or a reciprocating compressor. Compressor 12 is coupled to condenser 14 which in turn is coupled to expansion throttle 16. As used herein, the term "expansion throttle" refers to any device, such as an orifice, an expansion valve, or a capillary tube which reduces the pressure of refrigerant passing therethrough. Expansion throttle 16 is coupled to evaporator 18, which evaporator 18 is typically disposed in thermal contact with the freezer compartment of a household refrigerator. Evaporator 18 may comprise any type of evaporator including a spine fin evaporator or a spread serpentine evaporator as described in commonly assigned U.S. Pat. No. 5,157,943. Evaporator 18 should be configured, however, so as to be self-draining by gravity. In order for evaporator 18 to be self-draining by gravity, each section of evaporator 18 must be in a down flow direction such that liquid traps are not formed. Liquid traps within evaporator 18 would prevent liquid refrigerant from draining during compressor 12 shutdown.

By way of example and not limitation, FIG. 1 depicts expansion throttle 16 as a capillary tube with a fraction of its length in thermal contact with conduit 22, which connects evaporator 18 and compressor 12. Thermal contact such as this can be achieved by providing a thermal coupling material 25, (shown as cross-hatching in FIG. 1), between conduit 22 and expansion throttle 16 to facilitate thermal transfer. The heat transfer occurs in a counterflow arrangement with the flow within the expansion throttle 16 proceeding in a direction opposite to that of flow within conduit 22, this arrangement enhances the heat exchange efficiency.

More particularly, when controller 24 generates a compressor signal to activate compressor 12, such as in correspondence with a temperature sensor 27 detecting the temperature of the freezer or fresh food compartment has risen above some predetermined set temperature, high pressure gaseous refrigerant is discharged from compressor 12 and is condensed in condenser 14. The now-liquid refrigerant is expanded through expansion throttle 16 to a lower pressure and flows to evaporator 18. The refrigerant under low pressure, and correspondingly at a low temperature, enters evaporator 18, where the refrigerant is evaporated in a conventional manner. The evaporation of the refrigerant lowers the temperature in the freezer or fresh food compartment. Refrigeration system 10 typically includes air circulating fans, or the like, that direct air over and around evaporator 18 to more effectively provide heat transfer and uniform cooling within the freezer or fresh food compartment. The refrigerant vapor is then drawn into compressor 12, and the cycle continues until the temperature detected by temperature sensor 27, within the freezer or fresh food compartment, is reduced to a lower setpoint temperature and controller 24, monitoring the detected temperature, generates a compressor signal to de-activate compressor 12. During this cycle, refrigerant entering evaporator 18 may be cooled to a temperature which results in the formation of ice or frost on the surface of evaporator 18. Since ice accumulation will eventually cause cycle efficiency degradation, the ice must be removed.

More particularly, when controller 24 generates a compressor signal to de-activate compressor 12, such as when temperature sensor 27 detects the temperature of the freezer or fresh food compartment has been cooled to a temperature below some predetermined set temperature, compressor 12, which has just run, has an elevated temperature, typically above 150° F. In conventional refrigeration systems, the conduit connecting the evaporator and the compressor exits from the top of the evaporator thereby acting as a liquid refrigerant trap, preventing liquid refrigerant in the evaporator from draining to the hot compressor region. Accordingly, if no liquid refrigerant drains to the compressor, there is no need for a valve disposed within the connecting conduit to prevent evaporator refrigerant from unnecessarily heating the evaporator region. In accordance with this invention, however, conduit 22 is attached to the low point of evaporator 18 thereby allowing liquid refrigerant to drain by gravity from the bottom of evaporator 18 through conduit 22 to compressor 12. Accordingly, during periods of non-defrosting compressor 12 de-activation controller 24 generates a valve signal to control valve 20 causing control valve 20 to move to a closed position and correspondingly, during periods of compressor 12 activation, controller 24 generates a valve signal to control valve 20 causing control valve 20 to move to an open position.

Closure of the control valve 20 is necessary during compressor 12 de-activation in refrigeration system 10 to prevent liquid refrigerant from draining from evaporator 18 to compressor 12 during each compressor 12 de-activation, thereby adding heat into the evaporator region which necessitates removal via the refrigeration cycle. Opening of the control valve 20 is necessary during compressor 12 activation in refrigeration system 10 to allow the refrigerant to flow throughout the system.

In accordance with the instant invention, during a passive defrost mode, a mode in which only residual heat generated in normal use of the refrigeration cycle components is utilized for defrost, controller 24 generates a compressor signal to de-activate compressor 12. Control valve 20 remains in an open position following de-activation, or alternatively, is placed in an open position by a valve signal generated by controller 24 during passive defrost mode, such that evaporator 18 and compressor 18 are in flow communication with one another. Compressor 12, which has just run, has an elevated temperature, typically above 150° F. Evaporator 18, with ice and frost buildup on its surfaces, is the coldest component of refrigeration system 10, typically about −10° F. prior to defrosting. Liquid refrigerant, by force of gravity, drains from the bottom of evaporator 18 to compressor 12 through conduit 22. When the draining liquid refrigerant comes into contact with the hot compressor 12, the refrigerant evaporates and flows upwards through conduit 22 to the cold evaporator 18 surfaces and condenses. As indicated, in this embodiment, counter-current liquid and vapor refrigerant flow occurs within conduit 22. Condensation of the refrigerant upon evaporator 18 or within the vicinity of evaporator 18 releases the latent heat of vaporization of the refrigerant, resulting in heating of the surfaces of evaporator 18 and melting ice and frost buildup. If a conventional evaporator connection were used, however, the instant invention may further include a pumping device (not shown) coupled to evaporator 18 and to controller 24 such that during passive defrost mode, controller 24 generates a signal to the pumping device to pump liquid refrigerant out of evaporator 18 to conduit 22 so that the liquid refrigerant can drain to compressor 12, thereby initiating the passive defrost cycle. In this embodiment, control valve 20 would not be needed.

In accordance with the instant invention, refrigeration system 10 utilizes the residual heat which is already present within compressor 12 to defrost evaporator 18, thereby minimizing both the energy needs of refrigeration system 10 and the amount of heat deposited into the evaporator 18. Furthermore, refrigeration system 10 does not require the presence of a heating element to effect automatic defrost resulting in additional cost savings. Moreover, refrigeration system 10 is adapted such that the passive defrost mode is utilized only for short fixed periods of time each day, not each time compressor 12 is de-activated. Additionally, refrigeration system 10 can be incorporated into the more efficient and increasingly more popular hydro-carbon refrigeration systems since refrigeration system 10 has no heating element and therefore no spark source for the explosive hydro-carbon refrigerants.

The passive defrost mode is continued for as long as controller 24 keeps control valve 20 in an open position. Controller 24 generates a valve signal to close control valve 20 once it is determined that the temperature surrounding evaporator 18 has reached a defrost temperature which corresponds to a temperature at which all ice has melted or should have melted from the iced surfaces of evaporator 18. This can be accomplished with the aid of a defrost termination sensor 29 positioned within the evaporator region. Defrost termination sensor 29 generates a signal in correspondence with the temperature of the evaporator region. Controller 24 monitors the temperature to determine if a predetermined defrost temperature has been reached. Once defrost termination sensor 29 generates a signal indicating that the defrost temperature within the evaporator region has been reached, controller 24 generates a valve signal which causes control valve 20 to move to a closed position, thus preventing additional hot refrigerant vapor from entering the evaporator region. Alternatively, control valve 20 remains open for a predetermined defrosting time and after the allotted time has passed control valve 20 is closed by a valve signal generated by controller 24. In one embodiment, control valve 20 is placed in close proximity to the point that conduit 22 leaves the freezer compartment in order to prevent continued heat flow into evaporator 18 once control valve 20 is closed.

Figure 2:
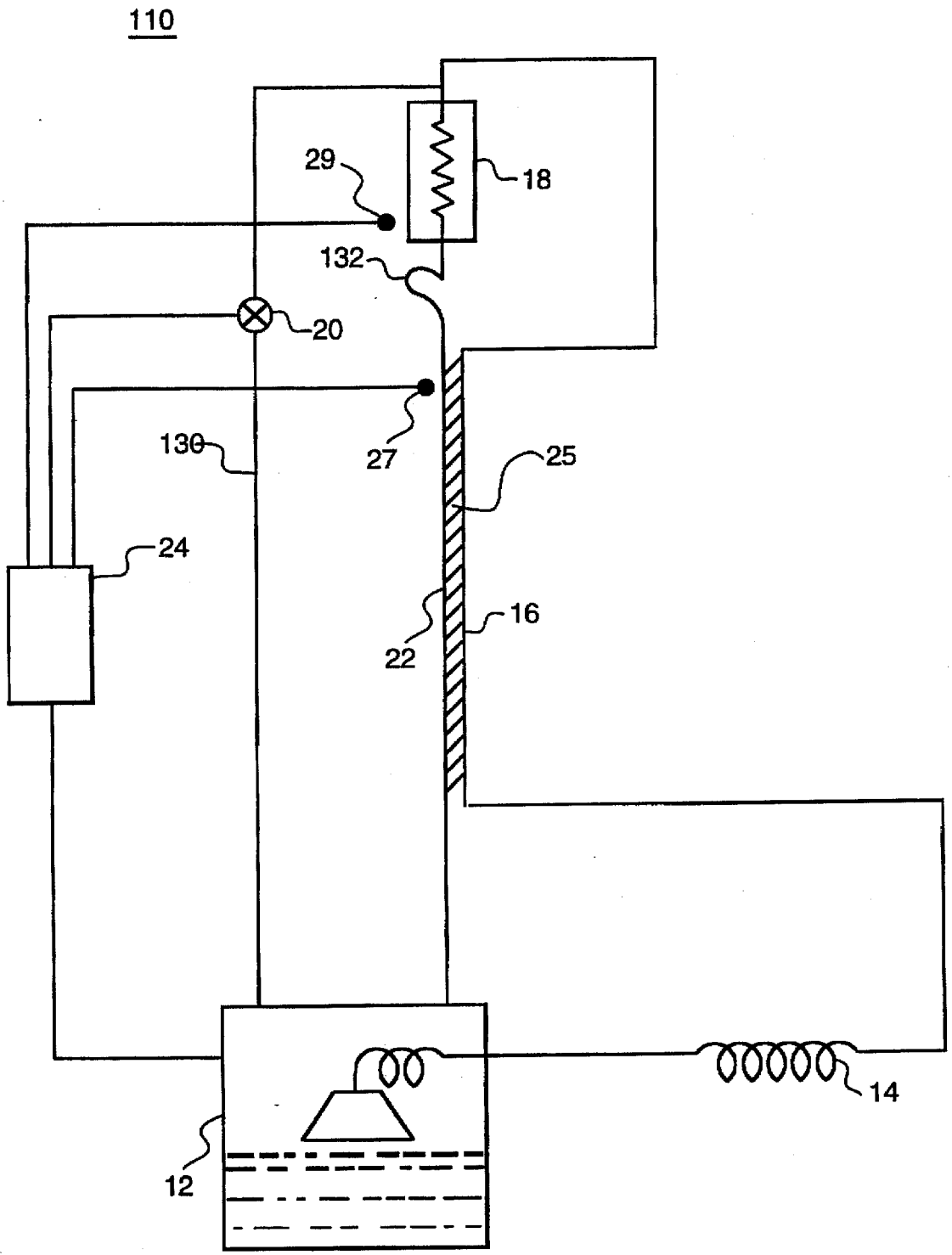
FIG. 2 is a schematic representation of another embodiment of a refrigeration system in accordance with the present invention.

FIG. 2 shows another embodiment of a refrigeration system 110 comprising compressor 12, condenser 14, expansion throttle 16, and evaporator 18. Refrigeration system 110 is similar to refrigeration system 10 of FIG. 1, except that refrigeration system 110 further comprises by-pass line 130 which provides flow communication between compressor 12 and the top of evaporator 18. Control valve 20 is disposed within by-pass line 130 to regulate flow therethrough.

In accordance with the instant invention, during passive defrost mode, controller 24 generates a compressor signal to de-activate compressor 12. Control valve 20 remains closed during compressor 12 activation and during compressor 12 de-activation unless passive defrost mode has been initiated. During passive defrost mode, controller 24 generates a valve signal to open control valve 20. Compressor 12, which has just run, has an elevated temperature, typically above 150° F. Evaporator 18, with ice and frost buildup on its surfaces, is the coldest component of refrigeration system 110, typically about −10° F. prior to defrosting. Liquid refrigerant, by force of gravity, drains from evaporator 18 to compressor 12 through a liquid trap 132 and conduit 22. When the draining liquid refrigerant comes into contact with hot compressor 12, the refrigerant evaporates and flows upwards to the cold evaporator 18 surfaces through by-pass line 130 and condenses on evaporator 18. The hydrostatic head of the liquid refrigerant within liquid trap 132 prevents refrigerant vapor from traveling up conduit 22. Accordingly, the vapor refrigerant is forced to travel through by-pass line 130, thus creating a circulating flow pattern to allow return of the liquid refrigerant to compressor 112. As indicated, in this embodiment, counter-current liquid and vapor refrigerant flow is not required within conduit 22 creating a natural flow pattern between evaporator 18 and compressor 12, which corresponds to a faster, and more efficient defrosting cycle. Condensation of the refrigerant upon evaporator 18 releases latent heat of vaporization, heating the surfaces of evaporator 18 and melting ice and frost buildup thereon. In this embodiment, bypass line 130 will carry only refrigerant vapor flow from compressor 12 to the top of evaporator 18 and conduit 22 will carry only liquid refrigerant flow from evaporator 18 to compressor 12 during defrost.

The passive defrost mode is continued for as long as controller 24 keeps control valve 20 in an open position. In one embodiment, control valve 20 is placed in close proximity to the point that by-pass line 130 leaves the freezer compartment in order to prevent continued heat flow into evaporator 18 once control valve 20 is closed.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A refrigeration system having a passive defrost capability, comprising:

an evaporator;

a compressor coupled to a low point of said evaporator via a conduit;

a control valve disposed in said conduit so as to control flow of refrigerant therethrough; and a controller coupled to said compressor and to said control valve to provide respective control signals thereto, said controller having a passive defrost mode in which said controller is adapted to generate a compressor signal to de-activate said compressor and a valve signal to open said control valve so that liquid refrigerant drains from the bottom of said evaporator through said conduit to said compressor whereby said draining liquid refrigerant is evaporated by said compressor and said vapor refrigerant flowing to and condensing near or upon said evaporator, melting ice buildup thereon.

2. A refrigeration system, in accordance with claim 1, wherein said control valve is an electric control valve.

3. A refrigeration system, in accordance with claim 1, wherein said refrigerant comprises a material selected from the group comprising dichlorodifluoromethane, 1,1,1,2-tetrafluoroethane, ammonia, propane, or any of the refrigerants classified as hydro-carbon refrigerants, for example isobutane.

4. A refrigeration system, in accordance with claim 1, further includes a temperature sensor coupled to said controller for detecting the temperature of a freezer and/or a fresh food compartment.

5. A refrigeration system, in accordance with claim 1, further including a defrost termination sensor coupled to said controller and positioned proximate said evaporator, said defrost termination sensor adapted to generate a signal to said controller in correspondence with the temperature of said evaporator.

6. A refrigeration system, in accordance with claim 1, wherein said evaporator is self-draining by gravity.

7. A refrigeration system having a passive defrost capability, comprising:

an evaporator having a top and a bottom;

a compressor coupled to said bottom of said evaporator via a conduit;

a by-pass line coupling said compressor with said top of said evaporator;

an control valve disposed in said by-pass line so as to control flow of refrigerant therethrough; and a controller coupled to said compressor and to said control valve to provide respective control signals thereto, said controller having a passive defrost mode in which said controller is adapted to generate a compressor signal to de-activate said compressor and a valve signal to open said control valve, wherein liquid refrigerant drains from the bottom of said evaporator through said conduit to said compressor, said draining liquid refrigerant being evaporated by said compressor and said vapor refrigerant, through said by-pass line, flowing to and condensing on said evaporator, melting ice buildup thereon.

8. A refrigeration system, in accordance with claim 7, wherein said control valve is a solenoid valve.

9. A refrigeration system, in accordance with claim 7, wherein said refrigerant comprises a material selected from the group comprising dichlorodifluoromethane, 1,1,1,2-tetrafluoroethane, ammonia, propane, or any of the refrigerants classified as hydro-carbon refrigerants, for example isobutane.

10. A refrigeration system, in accordance with claim 7, further comprising a liquid trap disposed within said conduit to prevent refrigerant vapor from flowing up from said compressor through said conduit to said evaporator region.

11. A refrigeration system, in accordance with claim 7, further includes a temperature sensor coupled to said controller for detecting the temperature of a freezer and/or a fresh food compartment.

12. A refrigeration system, in accordance with claim 7, further including a defrost termination sensor coupled to said controller and positioned proximate said evaporator, said defrost termination sensor adapted to generate a signal to said controller in correspondence with the temperature of said evaporator.

13. A refrigeration system, in accordance with claim 7, wherein said evaporator is self-draining by gravity.

* * * * *